US007926738B2

(12) United States Patent
Lu

(10) Patent No.: US 7,926,738 B2
(45) Date of Patent: Apr. 19, 2011

(54) LIQUID NEBULIZATION SYSTEM

(75) Inventor: Chun-Fu Lu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 215 days.

(21) Appl. No.: 12/332,518

(22) Filed: Dec. 11, 2008

(65) Prior Publication Data

US 2009/0242662 A1 Oct. 1, 2009

(30) Foreign Application Priority Data

Mar. 25, 2008 (TW) ..... 97110476 A

(51) Int. Cl.
*B05B 1/08* (2006.01)
*B05B 17/06* (2006.01)

(52) U.S. Cl. ..... 239/102.2; 239/102.1; 239/338

(58) Field of Classification Search ..... 239/4, 102.1, 239/102.2, 338; 128/200.14, 200.16
See application file for complete search history.

(56) References Cited

U.S. PATENT DOCUMENTS

| | | | |
|---|---|---|---|
| 5,518,179 A | 5/1996 | Humberstone et al. | |
| 6,439,474 B2 | 8/2002 | Denen | |
| 6,539,937 B1 | 4/2003 | Haveri et al. | |
| 2008/0088202 A1 * | 4/2008 | Duru | 310/316.01 |

* cited by examiner

*Primary Examiner* — Darren W Gorman
(74) *Attorney, Agent, or Firm* — Rabin & Berdo, P.C.

(57) ABSTRACT

Disclosed is a liquid nebulization system comprising a power supply unit, a signal generating unit, a liquid storage unit and a nebulizing unit. The signal generating unit receives power from the power supply unit to generate a main signal and at least an auxiliary signal, wherein the main signal and the auxiliary signal are added together to constructively and destructively interfere with one another to form a driving signal, further causing the nebulizing unit to nebulize the liquid contained in the liquid storage unit using the driving signal.

17 Claims, 4 Drawing Sheets

LIQUID NEBULIZATION SYSTEM

BACKGROUND OF THE INVENTION

1. Field of the Invention

The present invention relates to a liquid nebulization system, and more particularly to a vibration type liquid nebulization system.

2. Description of Related Art

Aerosol technology has been widely used in various fields such as temperature cooling, humidification, sterilization, dust suppression and medicine. As the demand for the aerosol technology has increased, many kinds of the nebulization systems have been developed for use in various fields. For example, in medicine, inhalators are used to create a fine spray of drug particles for delivery to the lungs upon inhalation, wherein such particles typically need to be below 5 μm in diameter to be effectively delivered to and absorbed by the alveoli. As another example, in agriculture, fog machines are used for greenhouse cooling and screening of excess sunlight to lower irrigation requirements, wherein the optimal fog particle diameter is about 17 μm.

Currently, nebulization systems consist of the differential pressure type, the plasma type and the vibration type, wherein the differential pressure type has been most widely applied. For example, aerosol bottles of liquid detergent, perfume and pesticide belong to the differential pressure type. Unfortunately, the differential pressure type of nebulization system is often prone to liquid leakage. However, such leakage rarely occurs in the plasma type nebulization system, making it more appropriate when leakage is unacceptable. In the plasma type liquid nebulization system, a high voltage of thousands of volts is connected to a metallic tapered rod to ionize liquid into nano-particles. However, such a design may put the user at risk of electric shock. As for the vibration type nebulization system, sonic vibration is induced by a high-frequency piezoelectrically-driven plate to produce liquid droplets. However, although no leakage or electric shock problems exist, high power consumption is often an issue with the vibration type of nebulizer.

As an example of a vibration type nebulizer, U.S. Pat. No. 5,518,179 discloses such a unit with a driving electrode that, when in operation, is driven using a self-resonant circuit with an actuator having a mechanical resonance close to 400 kHz with an amplitude of approximately 25V. The electrode circuit in combination with a self-tuning drive circuit provides excitation of the preferred vibration mode. However, a frequency tracking method is required to lock the resonant interval in order to operate the nebulization system. At the same time, a frequency tracking method is driven by a higher frequency and voltage, which are the cause of high power consumption. As another example, as disclosed in U.S. Pat. No. 6,539,937, a described nebulizer apparatus atomizes liquid solutions, delivering atomized medicine to a patient. The liquid contained in the nebulizer apparatus is vibrated at ultrasonic frequencies to atomize the liquid. The nebulization steps include adjusting the frequency at which the voltage source is supplied to the vibrating element until a measured electrical characteristic is within −2 dB of the electrical characteristic corresponding to one of the series resonant frequencies. Since the series resonant frequencies require a higher operating voltage, the problem of high power consumption also still exists. In order to solve the aforementioned problem of high power consumption, the control system for atomizing liquids with a piezoelectric vibrator as described in U.S. Pat. No. 6,439,474 discloses in a related diagram that the driving sequence of the piezoelectric actuation element is divided into alternate drive periods of 5.5 milliseconds duration, and sleep periods of from 9 to 18 seconds duration. During the 5.5-millisecond drive periods, the voltage used for driving the piezoelectric actuation element decreases exponentially from 3.3 volts down to about 1.2 volts. Thus, the piezoelectric actuating element is initially driven at a high amplitude, which has the effect of clearing liquid from its surface and initiates atomization; and then it is driven at significantly lower amplitudes, which are sufficient to maintain actuation with a minimal power consumption. The foregoing driving sequence of 5.5 milliseconds/18 seconds reduces the power consumption but causes the problem of significantly lowering the liquid nebulization amount.

Hence, it has become an issue to designers of modern nebulization systems to propose a better nebulization technique that does not increase the power consumption, or, even better, reduces the power consumption required by the nebulization system while still achieving a considerable nebulizing effect.

SUMMARY OF THE INVENTION

The present invention provides a vibration type liquid nebulization system that comprises: a liquid storage unit for storing a liquid; a power supply unit for supplying power; a signal generating unit that receives power from the power supply unit for generating at least a main signal and an auxiliary signal, wherein the main signal and the auxiliary signal are added together via constructive and destructive interference to form a resultant driving signal; and a nebulizing unit for nebulizing the liquid stored in the storage unit via the driving signal.

DETAILED DESCRIPTION OF PREFERRED EMBODIMENTS

The following illustrative embodiments are provided to illustrate the disclosure of the present invention. These and other advantages and effects can be readily understood by those in the art after reading the disclosure of this specification. The present invention can also be performed or applied by other differing embodiments. The details of the specification may be changed on the basis of different points and applications, and numerous modifications and variations can be devised without departing from the spirit of the present invention.

It is to be noted that the appended diagrams are simplified figures for illustrating the basic structure of the present invention. Hence, only components related to the present invention are indicated and the depiction of the components is not necessarily in accordance with the actual amount, shape, size-ratios and so on. In addition, for convenience, like components in figures of different embodiments are indicated by the same component symbols.

Figure 1:
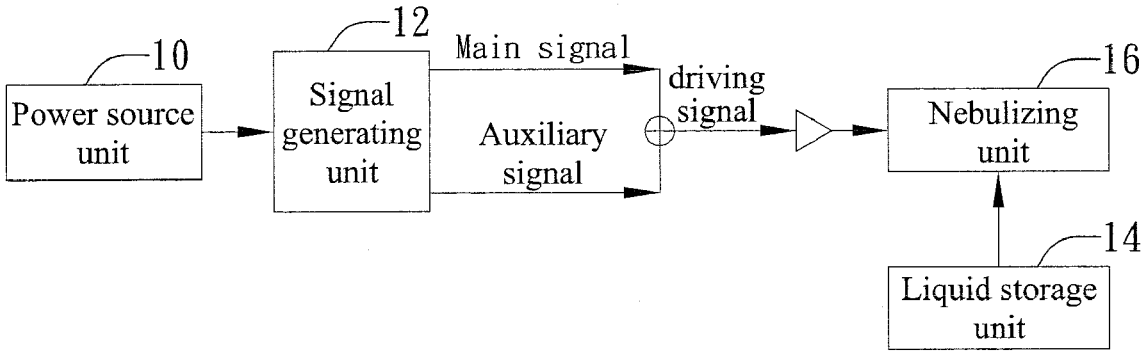
FIG. 1 illustrates a block diagram of the liquid nebulization system of the present invention.

The liquid nebulization system of the present invention utilizes the theory of constructive and destructive wave interference to create a separate higher peak-to-peak voltage driving signal to drive the nebulizing unit (i.e. piezoelectric actuator). The actual circuit configuration to accomplish this involves the parallel connection of more than one set of signal generating units, wherein, via the effect of interference theory, a higher peak-to-peak voltage signal is created to drive the piezoelectric component of the liquid nebulization system to achieve the effect of liquid nebulization. In order to make the characteristics of the liquid nebulization system of the present invention clearer, reference will be made to diagrams detailing embodiments of the liquid nebulization system of the present invention. Referring to FIG. 1, a block diagram of a liquid nebulization system of the present invention is illustrated. The liquid nebulization system includes: a power supply unit 10, a signal generating unit 12, a liquid storage unit 14, and a nebulizing unit 16.

The power supply unit 10 supplies power to the rest of the system and receives its power from either a wired electrical main or a battery, wherein the battery is one selected from the group consisting of a one-time-use battery, a rechargeable battery, a solar cell-charged battery, and a fuel cell.

The signal generating unit 12 creates a main signal and at least an auxiliary signal using power supplied by the power supply unit 10. For example, the main signal can be a high-frequency signal and the auxiliary signal can be a low-frequency signal. In the present embodiment, the signal generating unit 12 comprises two or more 555 timers, which is a common 8-pin integrated circuit used in a variety of timer applications. By simply connecting a capacitor and a resistor to each 555 timer, the resonant interval and the pulse width of the output may be adjusted. The pulse width of the main signal as well as the auxiliary signal can be controlled via the external resistor and capacitor, and the time interval is simply the product of capacitance and resistance, thereby achieving the purpose of periodic liquid ejection (i.e. periodic driving such as a one-second halt for every two-seconds of operation or a three-second halt for every one-second of operation). Note that the present invention is not bound by any specific type of timer; other timers such as the 556, 74HCXXX and other timer ICs are also applicable in the invention. And, in the case of that the 556 is employed, only one such chip is required to create the main signal and the auxiliary signal, in that it has two output terminals.

Figure 2:
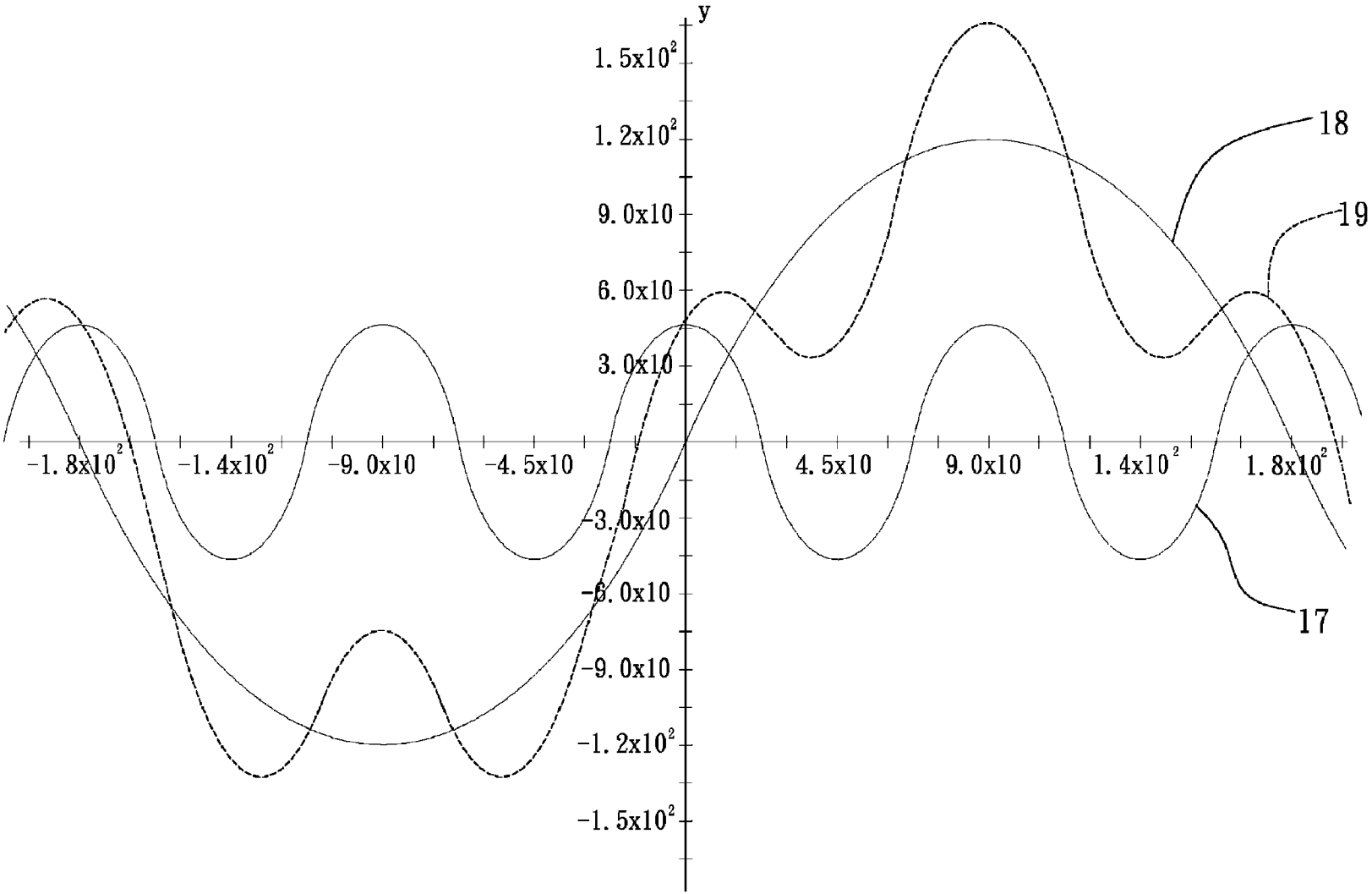
FIG. 2 is a diagram showing a driving signal formed as a result of the coherent addition of a main signal and an auxiliary signal in the liquid nebulization system of the present invention.

The liquid nebulization system of the present invention, based on interference theory, creates a composite driving signal which is the result of the coherent addition of the main signal and at least one auxiliary signal generated by the signal generating unit 12. The main signal and the at least one auxiliary signal are added together to constructively interfere with each other to form the resultant driving signal having a desired waveform. As shown in FIG. 2, a composite driving signal 19 is the result of the coherent addition of a main signal 17 (high-frequency signal) and the auxiliary signal 18 (low-frequency signal) generated by the signal generating unit 12. Hence, the amplitude swing of the composite driving signal 19, as a result of the coherent addition, is greater than the amplitudes of both the main signal 17 and the auxiliary signal 18 as shown by the vertical axis (y-axis). In other words, the main signal 17 and the auxiliary signal 18 generated by the signal generating unit 12 form a resultant signal with a higher peak-to-peak voltage over a waveform cycle via constructive and destructive signal interference so as to thus reduce the supply voltage needed to actuate the liquid nebulization system (i.e. effect a power consumption reduction). The exact calculation of the power consumption will be explained shortly. Regarding the waveform shapes, the waveforms shown in FIG. 2 comprise one selected from the group consisting of sine waves, triangle waves, trapezoid waves, and square waves. The main signal and the auxiliary signal are signals of either the same or different frequencies, or signals of either the same or different amplitude swings.

As the vibration type liquid nebulization system controls the voltage variation by connecting an external capacitor and resistor to each timer, and effects liquid nebulization via periodic voltage variation, the power consumption of the liquid nebulization system having the capacitor is evaluated as:

$$P=2\pi fCV^2$$

The liquid nebulization system of this embodiment is driven by the main signal and the auxiliary signal, which two voltage signals of 15 volts. Hence, the two sets of signals, when connected in cascode, form an equivalent voltage signal of 25 volts because of the interference effect. The power consumption of the liquid nebulization system is calculated as:

$$P_1=2\times 2\pi fC15^2=900\pi fc$$

In comparison, the conventional liquid nebulization system is driven by a set of signals having a voltage of 25 volts. Thus, the power consumption of the conventional liquid nebulization system is $$P_2=2\pi fC25^2=1250\pi fC$$

Hence, the liquid nebulization system according to the present embodiment is more power efficient than the conventional liquid nebulization system, as described in the expression $(1250\pi fC-900\pi fC)/(900\pi fC)=0.39$, which implies that the power consumption of the liquid nebulization system of the present invention is reduced by 39% as compared with that of the conventional 25-volt driven liquid nebulization system.

The liquid storage unit 14 stores a liquid selected from the group consisting of water, deodorant, essential oil, and chemical solvent. However, it is also suitable for storing liquids used in other fields.

The nebulizing unit 16, based on the main signal and the auxiliary signal generated by the signal generating unit 12, forms the composite driving signal so as to nebulize the liquid in the liquid storage unit 14 using the driving signal selected. The waveform of the selected driving signal is amplified by an amplifier. The nebulizing unit 16 is a selection of a combination of the piezoelectric ring and the orifice plate, a combination of the piezoelectric plate and the orifice plate, and a combination of the piezoelectric plate and the vibration plate. The specific structure of the nebulizing unit 16 will be explained as follows.

Based on the above information, the liquid nebulization system of the present invention uses at least two sets of signals to control the nebulizing unit, and the output voltage signal resulting from to the two sets of signals is of a higher voltage level because of the interference effect. Hence, the liquid nebulization system of the present invention provides a better nebulizing effect, and, at the same time, reduces power consumption.

Figure 3:
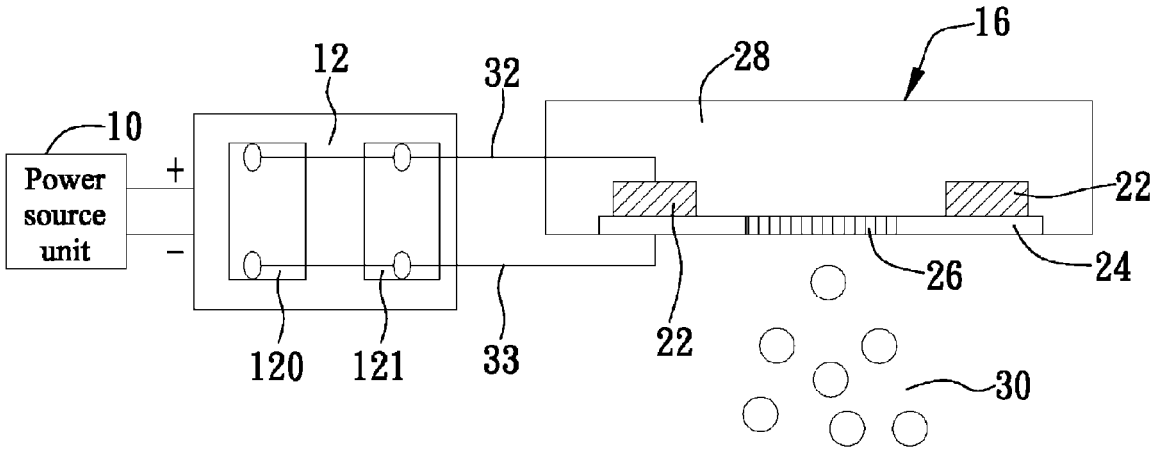
FIG. 3 shows the liquid nebulization system according to the first embodiment of the present invention.

FIG. 3 illustrates a liquid nebulization system according to the first embodiment of the present invention. Note that the diagrams corresponding to the following embodiments are cross-sectional diagrams illustrating the structure of the nebulizing unit 16. As shown in the diagram, the signal generating unit 12 of the liquid nebulization system according to the present embodiment adopts two 555 timers (120, 121) to generate the aforesaid main signal and auxiliary signal. The two 555 timers (120, 121) are connected in parallel. As described above, the signal generating unit 12 is not limited to the use of 555 timers, other timers such as 556, 74HCXXX are also applicable. The nebulizing unit 16 according to the present embodiment includes a piezoelectric ring 22 and an orifice plate 24; a plurality of orifices 26 used by the piezoelectric ring 22 that surrounds the orifice plate 24; a connection, via two signal lines (32, 33), between the signal generating unit 12 and the piezoelectric ring 22, thereby transmitting the composite driving signal that results from the interference of the main signal and the auxiliary signal generated by the signal generating unit 12 to the piezoelectric ring 22 of the nebulizing unit 16, so as to allow the piezoelectric ring 22 to vibrate based on the received composite driving signal. Furthermore, a liquid 28 stored in the liquid storage unit 14 is ejected as micro liquid droplets 30 via the plurality of fine orifices 26 of the orifice plate 24, thereby nebulizing the liquid. As the liquid nebulization system of the present invention produces a lower peak-to-peak voltage from a higher voltage using interference theory to drive the piezoelectric ring 22, the same liquid nebulizing effect is able to be achieved using lower power consumption.

In addition, the liquid nebulization system of the present invention adopts more than one set of signals as the driving voltage for activating the piezoelectric ring 22, and those sets of signals generate different results or effects due to differences in the tolerance of the orifice plates made by different companies. In other words, each orifice plate creates a specific overall resonant frequency peak due to the differences in manufacturing tolerances and the mass of the liquid being nebulized. For example, in a liquid nebulization system with two sets of the nebulizing units, the first set of the nebulizing units has an overall resonant frequency peak of 46 kHz and the overall resonant frequency peak of the second set of the nebulizing units is 50 kHz. Suppose that a 50-kHz signal is used to drive the first set of the nebulizing units, the set may not achieve the expected liquid nebulizing quantity, or, even worse, fail to respond. In such a situation, perhaps only the 46-kHz signal can successfully drive the first set of the nebulizing units, allowing the first set of the nebulizing units to achieve the nebulizing effect. The conventional liquid nebulization system adopts a frequency-tracking circuit to solve such a problem, wherein the circuit, under the circumstance when the first set of the nebulizing units is to be driven, automatically adjusts the frequency of the signal-generating unit to 46 kHz. Then, when the second set of the nebulizing units is to be driven, the frequency of the signal generating unit is automatically adjusted to 50 kHz. However, this frequency tracking circuit is unable to drive the two sets of the nebulizing units at the same time. On the other hand, as the liquid nebulization system of the present invention includes more than one set of signals (for example, the signal generating unit 12 could simultaneously generate both a 46-kHz signal and a 50-kHz signal), signals of more than one frequency are provided, which is sufficient to drive the first set of the nebulizing units and the second set of the nebulizing units as described above, and, at the same time, drive the two sets of the nebulizing units for liquid nebulization. Hence, the liquid nebulization system of the present invention, in addition to reducing power consumption, provides more than one set of driving frequencies due to the utilization of more than one set of signals, thereby increasing the operating range of driving the nebulizing unit.

Figure 4:
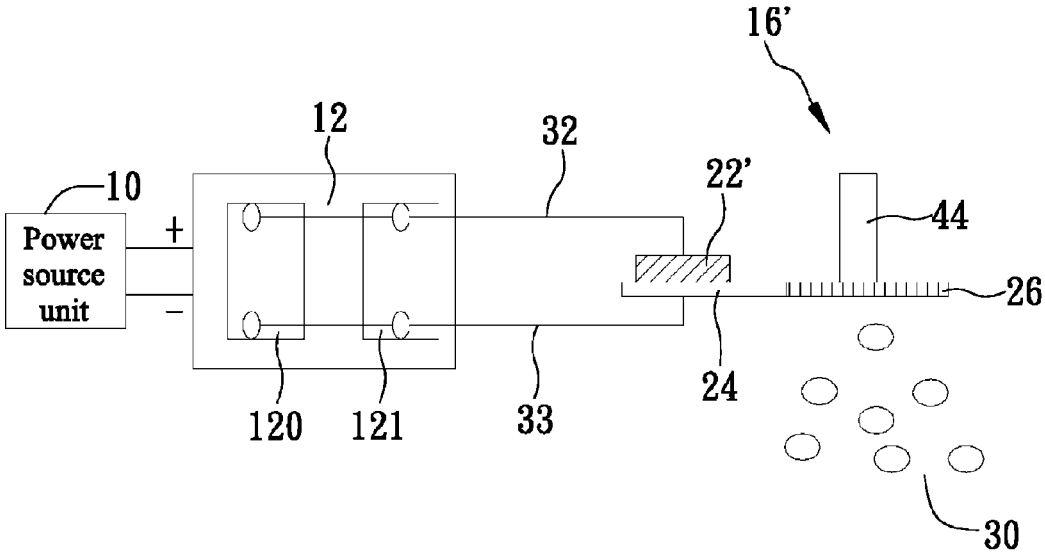
FIG. 4 shows the liquid nebulization system according to the second embodiment of the present invention.

As shown in FIG. 4, a liquid nebulization system according to the second embodiment of the present invention is illustrated. The present embodiment is generally the same as the first embodiment in terms of the structure. The main difference is as follows. As shown in the diagram, a nebulizing unit 16' according to the present embodiment includes a piezoelectric component 22', an orifice plate 24 and a capillary pipe 44, wherein the piezoelectric component 22' of the present embodiment is in the shape of either a plate or a block and positioned on any side of the orifice plate 24. In addition, the capillary pipe 44 supplies liquid to the nebulization system. The design of such a structure is to fulfill the needs of different fields. For example, in the medicine field, the structure aims to provide a more precise nebulizing range and quantity.

Figure 5:
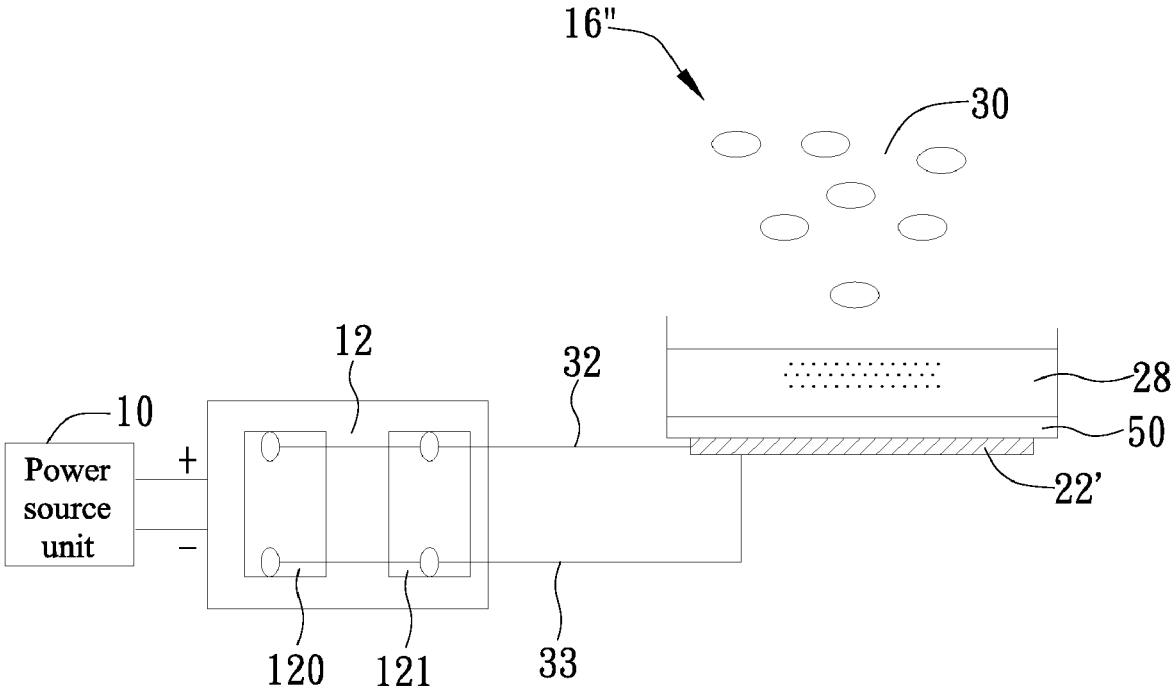
FIG. 5 shows the liquid nebulization system according to the third embodiment of the present invention.

Referring to FIG. 5, a liquid nebulization system according to the third embodiment of the present invention is illustrated. The present embodiment is generally the same as the first embodiment in terms of the structure. The main difference is as follows. As shown in the diagram, a nebulizing unit 16" according to the present embodiment includes a piezoelectric component 22' and a vibration plate 50. In the present embodiment, the piezoelectric component 22' and the vibration plate 50 vibrate at a high frequency to nebulize liquid which then floats in the air. The principle is to control the frequency such that it is sufficiently high to nebulize the liquid into micro droplet particles that are successfully suspended in the air. In other words, the liquid nebulization delivers the liquid to the surface of the liquid via the high-frequency vibration wave. Hence, the present embodiment does not need an orifice plate. In practical applications, the liquid nebulization system according to the present embodiment is used in gardening, landscaping, and garden-design or in humidifiers.

In comparison with the conventional technique, the liquid nebulization system of the present invention effectively solves the high power consumption problem due to driving of the piezoelectric components using the method of frequency-tracking in the conventional liquid nebulization system. However, the liquid nebulization system of the present invention, in the situation where the power supply unit supplies a low voltage signal, uses interference theory to convert a lower voltage peak-to-peak signal to a higher voltage peak-to-peak output signal in order to drive the piezoelectric component. Therefore, the liquid nebulization system, in addition to reducing power consumption, also achieves the effect of expanding the operating range by providing more than one set of driving frequencies.

The foregoing embodiments and advantages are merely exemplary and are not to be construed as limiting the present invention. Many alternatives, modifications, and variations will be apparent to those skilled in the art. In the claims, means-plus-function clauses are intended to cover not only the structures described herein but also structural equivalents.

What is claimed is:

1. A liquid nebulization system comprising:

a liquid storage unit for containing a liquid to be nebulized;

a power supply unit for supplying the electrical power;

a signal generating unit for providing a driving signal comprising a main signal and at least one auxiliary signal, wherein the signal generating unit comprises two or more timers, and each of the timers is connected with a capacitor and a resistor; and a nebulizing unit for nebulizing the liquid stored in the liquid storage unit using the driving signal directly output from the signal generating unit, and being electrically connected to the signal generating unit for the nebulizing unit to periodically eject the liquid.

2. The liquid nebulization system of claim 1, wherein the signal generating unit receiving power from the power supply for generating at least a main signal and an auxiliary signal, wherein such generated signals are then added together to constructively interfere with each other to form a resultant driving signal having a desired waveform.

3. The liquid nebulization system of claim 1, wherein the selected driving signal is amplified by an amplifier.

4. The liquid nebulization system of claim 1, wherein the liquid stored in the liquid storage unit is one selected from the group consisting of water, perfume, essential oil, and chemical solvent.

5. The liquid nebulization system of claim 1, wherein the nebulizing unit includes a piezoelectric ring and an orifice plate.

6. The liquid nebulization system of claim 1, wherein the nebulizing unit includes a piezoelectric plate and an orifice plate.

7. The liquid nebulization system of claim 1, wherein the nebulizing unit includes a piezoelectric plate and a vibration plate.

8. The liquid nebulization system of claim 1, wherein the waveform of the main signal is one selected from the group consisting of sine wave, triangle wave, trapezoid wave, and square wave.

9. The liquid nebulization system of claim 1, wherein the waveform of the auxiliary signal is one selected from the group consisting of sine wave, triangle wave, trapezoid wave, and square wave.

10. The liquid nebulization system of claim 1, wherein the driving signal is generated from the combination of the main signal and the auxiliary signal of the same frequency.

11. The liquid nebulization system of claim 1, wherein the driving signal is generated from the combination of the main signal and the auxiliary signal of different frequencies.

12. The liquid nebulization system of claim 1, wherein the driving signal is generated from the combination of the main signal and the auxiliary signal of the same peak-to-peak amplitude swing.

13. The liquid nebulization system of claim 1, wherein the driving signal is generated from the combination of the main signal and the auxiliary signal of different peak-to-peak amplitude swings.

14. The liquid nebulization system of claim 1, wherein the signal generating unit periodically forms the driving signal and the nebulizing unit regularly nebulizes the liquid in the liquid storage unit.

15. The liquid nebulization system of claim 1, wherein the power supply unit is one of a wired electrical main and a battery.

16. The liquid nebulization system of claim 15, wherein the battery is one selected from the group consisting of a one-time-use battery, a rechargeable battery, a solar cell-charged battery, and a fuel cell.

17. The liquid nebulization system of claim 1, wherein two or more of the timers are connected in parallel.

* * * * *